US006952663B2

(12) United States Patent
Duret et al.

(10) Patent No.: US 6,952,663 B2
(45) Date of Patent: Oct. 4, 2005

(54) AUTOMATIC PIPE GRIDDING METHOD ALLOWING IMPLEMENTATION OR FLOW MODELLING CODES

(75) Inventors: Emmanuel Duret, Rueil Malmaison (FR); Isabelle Faille, Carrières sur Seine (FR); Eric Heintze, Meudon (FR)

(73) Assignee: Institut Francais Du Petrole, Rueil-Malmaison Cedex (FR)

( * ) Notice: Subject to any disclaimer, the term of this patent is extended or adjusted under 35 U.S.C. 154(b) by 848 days.

(21) Appl. No.: 09/883,402

(22) Filed: Jun. 19, 2001

(65) Prior Publication Data

US 2002/0046013 A1 Apr. 18, 2002

(30) Foreign Application Priority Data

Jun. 23, 2000 (FR) ..... 00 08200

(51) Int. Cl.[7] ..... G06G 7/48
(52) U.S. Cl. ..... 703/6; 703/1; 703/9; 702/22
(58) Field of Search ..... 703/1–2, 6–10; 702/22–24

(56) References Cited

U.S. PATENT DOCUMENTS

| | | | | |
|---|---|---|---|---|
| 5,274,643 A | | 12/1993 | Fisk | 370/238 |
| 5,550,761 A | | 8/1996 | Pauchon et al. | 703/9 |
| 5,960,187 A | | 9/1999 | Faille et al. | 703/12 |
| 6,336,085 B1 | * | 1/2002 | Ueda et al. | 703/9 |
| 6,434,495 B1 | * | 8/2002 | Kitamura et al. | 702/50 |

FOREIGN PATENT DOCUMENTS

EP 0 626 652 11/1994

OTHER PUBLICATIONS

John et al, "A Coupled Multigrid Method for Nonconforming Finite Element Discretizations of the 2D–Stokes Equation," Computing (1999)(paper available at http://citeseer.ist.psu.edu/john99coupled.html).*

Pieper, "Observations on Convergence Problems of Pipeline Networks," IEEE Proceedings of the 13th Southeastern Symposium on System Theory, pp. 38–41 (Mar. 1998).*

* cited by examiner

*Primary Examiner*—Samuel Broda
(74) *Attorney, Agent, or Firm*—Antonelli, Terry, Stout & Kraus, LLP

(57) ABSTRACT

An automatic pipe gridding method allowing implementation of codes for modelling fluids carried by pipes is disclosed which has for example an application for oil pipes. The method comprises, considering a minimum and a maximum grid cell size, subdividing the pipe into sections including bends, positioning cells of minimum size on either side of each bend, positioning large cells whose size is at most equal to the maximum size in the central portion of each section, and distributing cells of increasing or decreasing size on the intermediate portions of each section between each minimum-size cell and the central portion. The method preferably comprises a prior stage of simplification of the pipe topography by means of weight or frequency spectrum analysis, so as to reduce the total number of cells without affecting the representativeness of the flow model obtained with the grid pattern.

30 Claims, 7 Drawing Sheets

AUTOMATIC PIPE GRIDDING METHOD ALLOWING IMPLEMENTATION OR FLOW MODELLING CODES

BACKGROUND OF THE INVENTION

1. Field of the Invention

The present invention relates to an automatic pipe gridding method allowing implementation of codes for modelling fluids carried by these pipes.

2. Description of the Prior Art

The modes of flow of multiphase fluids in pipes are extremely varied and complex. Two-phase flows, for example, can be stratified, the liquid phase flowing in the lower part of the pipe, or intermittent with a succession of liquid and gaseous plugs, or dispersed, the liquid being carried along as fine droplets. The flow modes vary notably with the inclination of the pipes in relation to the horizontal and it depends on the flow rate of the gas phase, on the temperature, etc. Slippage between the phases, which varies according to whether the ascending or the descending pipe sections are considered, leads to pressure variations without there being necessarily any compensation. The characteristics of the flow network (dimensions, pressure, gas flow rate, etc.) must be carefully determined.

The TACITE simulation code takes into account a certain number of parameters that directly influence the physics of the problem which is considered. Examples of these parameters are the properties of the fluids and of the flow modes, the topographic variations (length, inclination, diameter variations, etc.), the possible roughness of the pipes, their thermal properties (number of insulating layers and their nature), or the arrangement of equipments along the pipe (pumps, injectors, separators, etc.) that lead to physical flow changes.

Gridding of a physical domain is an essential stage within the scope of numerical simulation. The validity of the results and the calculating times depend on the quality thereof. It is therefore fundamental to provide the code with a correct grid prior to starting simulation. The quality of a grid is generally judged from its capacity to properly describe physical phenomena without simulation taking up too much time, so that there always is an optimum grid for each problem studied. An unsuitable grid can lead, during implementation of the numerical pattern that governs the simulation, to errors that are difficult to detect, at least initially, and can even make calculation impossible and stop the execution of the code if it is excessively aberrant. Code users are not necessarily experienced enough in numerical analysis to produce a correct grid likely to really take into account the physical phenomena to be studied.

The topography of a cylindrical pipe can be compared to a succession of segments of lines connecting successive points. In cartesian coordinates, two successive points of the pipe on the vertical (ascending or descending) portions thereof can have the same abscissa (curve A in FIG. 1). It is therefore preferable to represent the elevation of each point as a function of its curvilinear abscissa along the pipe. With this mode of representation, successive points of the pipe of different elevations necessarily have two distinct curvilinear abscissas and the slope of the pipe sections is at most 45° to the horizontal (case of absolutely vertical ascending or descending sections, the curve in FIG. 1). One ordinate and only one always corresponds to an abscissa.

With some physical sense, certain gridding errors can be prevented. A finer grid pattern can be imposed in places of the pipe likely to undergo great physical parameter variations if they can be foreseen. Less calculations are thus carried out in each time interval while keeping the desired fineness in the important places. However, going from a fine cell to a coarser cell must be continuous with a view to obtaining a continuous solution.

FIG. 2*a* shows for example a 2-km long W-shaped pipe section comprising four 500-m long section. If such a pipe is discretized with cells having a constant 40-m interval from beginning to end, the important points of the route at 500 m and 1500 m are left out. The simulation will not allow correctly showing the accumulation of liquid at these lower points of the topography. More important yet, the calculation is distorted by the fact that the angles of the W are replaced by horizontal segments of lines (FIG. 2*b*). The physical phenomena observed are thus not the phenomena that are sought.

The method according to the invention allows obtaining automatic gridding or discretization of a pipe taking into account, in the best possible way, the topography and the physical parameters that affect the flow physics, subjected to the following constraints:

1—Ensure calculation convergence;

2—Best represent large accumulations of liquid at the lower points of the pipe;

3—Place the equipments on a cell edge;

4—Impose the same order of length on two consecutive cells;

5—Respect the total length of the pipe;

6—Limit the number of cells to the possible minimum by respecting the previous constraints so as not to penalize simulation with the calculating time.

Respecting the previous six constraints is not easy, but it is essential in order not to grid the pipe studied homogeneously, without having to care about the physics of the problem, like most automatic gridders do.

In order to limit the number of cells, one has to try to simplify, if possible, the topography in order to keep only the zones of the pipe where the significant profile variations likely to significantly influence the physical phenomena are present.

SUMMARY OF THE INVENTION

The method according to the invention allows automatic 1D gridding of a pipe exhibiting any topography or profile over the total length thereof, in order to facilitate implementation of flow modelling codes. The grid obtained with the method has a distribution of cells of variable dimensions, suitable to best take into account the flow physics.

The method according to the invention finds applications in many spheres. It can notably be used in the sphere of hydrocarbon production for implementation of codes allowing simulation of multiphase flows in oil pipes from production sites to destination sites.

The grid obtained by means of the method can notably be used for implementing the TACITE modelling code (registered trademark) intended to simulate steady or transient hydrocarbon flows in pipes. Various algorithms allowing to carry out flow simulation according to the TACITE code from the subject of U.S. Pat. No. 5,550,761 and French Patent 2,756,044 and FR-2,756,045 (U.S. Pat. No. 5,960,187).

The method is characterized in that, after defining a minimum and a maximum grid cell size, the pipe is subdivided into sections delimited by bends, a cell of minimum size is positioned on either side of each bend, large cells whose size is at most equal to the maximum size are positioned in the central portion of each section, and cells of increasing or decreasing sizes are distributed on the intermediate portions of each section between each minimum-size cell and the central portion.

The distribution of the cells of increasing or decreasing sizes on the portions of each intermediate section between each minimum-size cell and the central portion is for example obtained by determining the points of intersection, with each pipe section, of a pencil of lines concurrent at one point and forming a constant angle with one another.

The position of the vertex of the pencil of lines is for example determined on an axis passing through a bend of the pipe and perpendicular to each section, at a distance therefrom that depends on the size of the extreme cells of each intermediate portion and on the distance between them.

Automatic positioning of the cells with smaller cells in the neighbourhood of the ends of each section allows exercising great care in modelling of the phenomena in the pipe portions exhibiting changes of direction (inflection or bend).

The method according to the invention preferably comprises previous simplification of the pipe topography so that the total number of cells of the pipe grid allows realistic modelling of the phenomena physics within a fixed time interval.

According to a first implementation mode, the method comprises representing the pipe in form of a graph connecting the curvilinear abscissa and the level variation, and simplifying the number of sections a) by assigning to each point between two successive sections a weight taking into account the length of the sections and the respective slopes thereof, b) by selecting, from among the points arranged in increasing or decreasing order of weight, those whose weight is the greatest, the simplified topography being that of the graph passing through the points selected.

Selection of the points of the pipe whose weight is the greatest is obtained for example by locating, in the arrangement of points, a weight discontinuity that is above a certain fixed threshold.

According to another implementation mode, the method comprises representing the pipe in form of a graph connecting the curvilinear abscissa and the level variation, and simplifying the number of sections a) by forming the frequency spectrum of the curve representative of the pipe topography, b) by attenuating the highest frequencies of the spectrum showing the slightest topography variations, and c) by reconstructing a simplified topography corresponding to the rectified frequency spectrum.

Selection is made for example a) by sampling the curve representative of the pipe topography with a sampling interval that is so selected that the smallest section of the pipe contains at least two sampling intervals, b) by determining the frequency spectrum of the curve sampled by application, c) by correcting the spectrum by low-pass filtering whose cutoff frequency is selected according to a fixed maximum number of cells for subdividing the pipe, and d) by determining the topography corresponding to the rectified frequency spectrum.

The two automatic simplification modes described above can be applied independently of one another or successively, the second mode being preferably applied when the first mode does not allow obtaining a notable simplification of the topography.

BRIEF DESCRIPTION OF THE DRAWINGS

Other features and advantages of the method according to the invention will be clear from reading the description hereafter of non limitative examples, with reference to the accompanying drawings wherein.

DETAILED DESCRIPTION OF THE INVENTION

I) Simplification of the Topography of a Pipe

The global shape of any profile is generally not difficult to bring out at first sight. The method according to the invention allows, by means of purely mathematical criteria, automatic determination of the configuration of a pipe based on a spectral analysis of the curve representative of the profile variations. Among all the spectra that can be associated with a given topography, a spectrum allowing distinguishing the portions of the profile to be simplified and the important profile portions is sought.

I-1) First Simplification Mode

Figure 1:
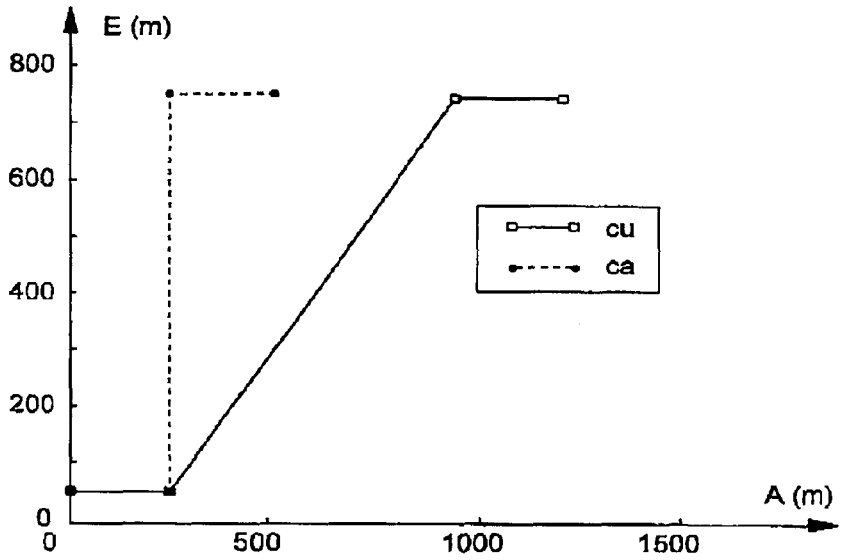
FIG. 1 shows two diagrammatic representations of the variation of elevation (E) of a pipe as a function of abscissa (A), according to whether the abscissa is a cartesian abscissa (ca) or a curvilinear abscissa (cu)
Figure 2A:
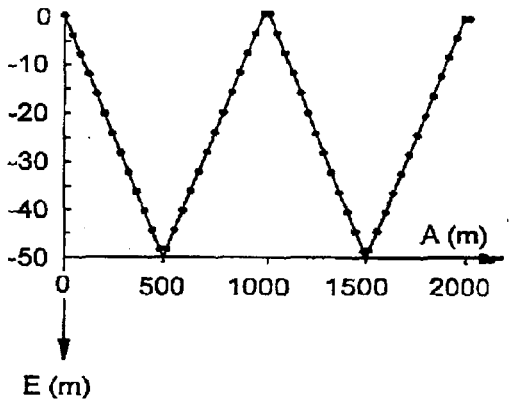
FIGS. 2*a*, 2*b* respectively show the diagrammatic topography of a W-shaped pipe in curvilinear coordinates, and an enlarged part of this topography, discretized with a suitable grid pattern.
Figure 2B:
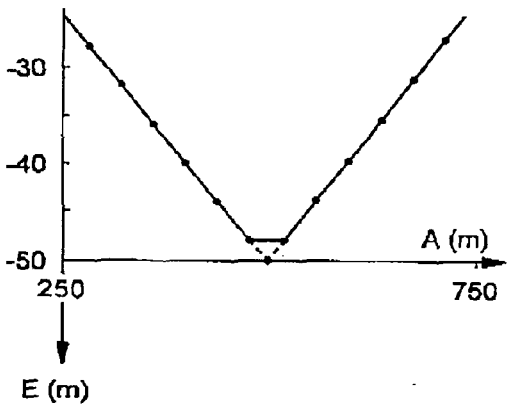
Figure 3:
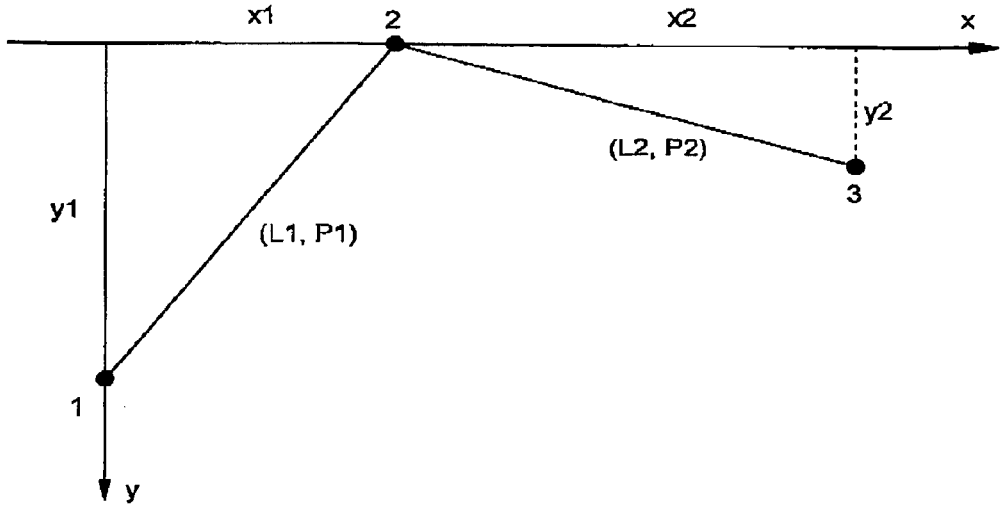
FIG. 3 shows a mode of assigning a weight (P) to points of the topography of a pipe.

In a topography, the only criteria according to which a point can be simplified in relation to another can only be the lengths of the sections surrounding it and the angular difference between them (FIG. 3). When the two (Section indices)–(Section lengths) and (Curvilinear abscissa of the points)–(Angular difference of the incoming and outgoing sections) "spectra" are constructed, it appears that they exhibit notable differences in their orders of magnitude, and also that these two spectra are independent so that, while simplifying negligible points in one, important points may have been suppressed in the other.

In order to group these two spectra into a single spectrum, each topographic point is assigned a weight that takes into account the section lengths and the angular differences that separate them. The following weighting is used for example:

$$\text{Weight} = \frac{L_1 \cdot L_2}{L_1 + L_2}(P_2 - P_1)^2$$

wherein $L_1$ and $L_2$ are the lengths of the sections, and $$P_1 = \frac{y_1}{x_1} \text{ and } P_2 = \frac{y_2}{x_2}$$

are the slopes. Thus, for the same lengths, the sections separated by the smallest slope difference will be simplified. And, for the same angles, the shortest lengths will be simplified.

Construction of the Spectrum

Figure 4:
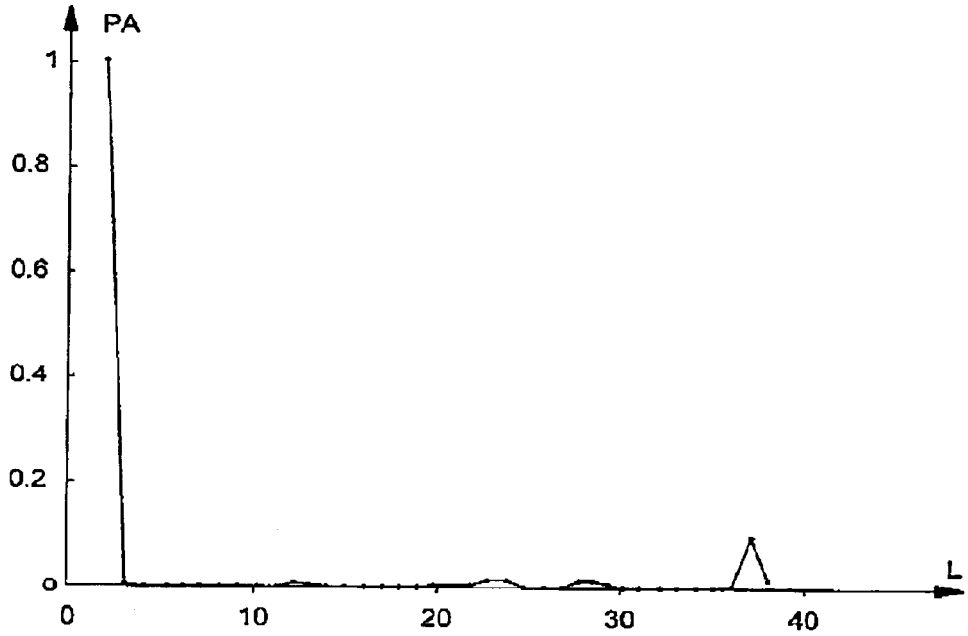
FIG. 4 shows an example of dimensionless weight spectrum (PA) as a function of length (L)
Figure 5:
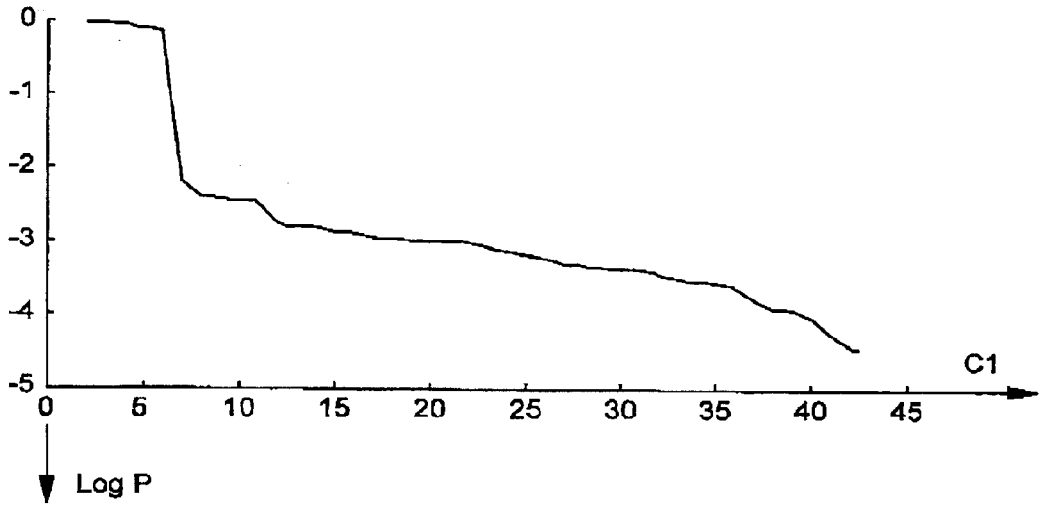
FIG. 5 shows an example of arrangement of points in decreasing weight plateaus; allowing to locate the position of a threshold and to simplify the topography of the pipe.

In most cases, the (Curvilinear abscissa–Weight) spectrum comprises a succession of peaks of all sizes. These spectra, such as the spectrum shown in FIG. 4, cannot be directly analyzed generally. Under such conditions, the technique used here consists in classifying weights (P) in increasing or decreasing order and in assigning thereto the corresponding index of classification (CI) by weight from 1 to N. A (Log Weight–Index) representation is preferably used, which better shows the orders of magnitude because a jump by n on such a spectrum means a $10^a$ ratio on the weights. All the weights with the same order of magnitude are arranged on more or less horizontal plateaus. Two weights of different orders of magnitude are separated by a vertical segment of a line. A cascade spectrum is obtained, which allows readily reading the various orders of magnitude present in the topography. In the example of FIG. 5 for instance, the logarithmic spectrum Log P contains two distinct plateaus separated by a vertical segment.

The first triplet of consecutive points of the spectrum, defined for example by a threshold ΔP set on the logarithmic scale (ΔP=1 for example) between the second and the third, which follows a jump that is less than ΔP between the first and the second, is sought. The first two points are of the same order of magnitude. All the following points are of a negligible order of magnitude in relation to the first two points. One thus makes sure that all the weights on the right of the triplet in question will be at least 10 times smaller than the weight of the second one and therefore negligible in relation to the upstream points. The points of curvilinear abscissa corresponding to the greatest weights selected are selected in the correspondence table (weight index-curvilinear abscissa). The simplified topography will be the line passing through these points.

Figure 6:
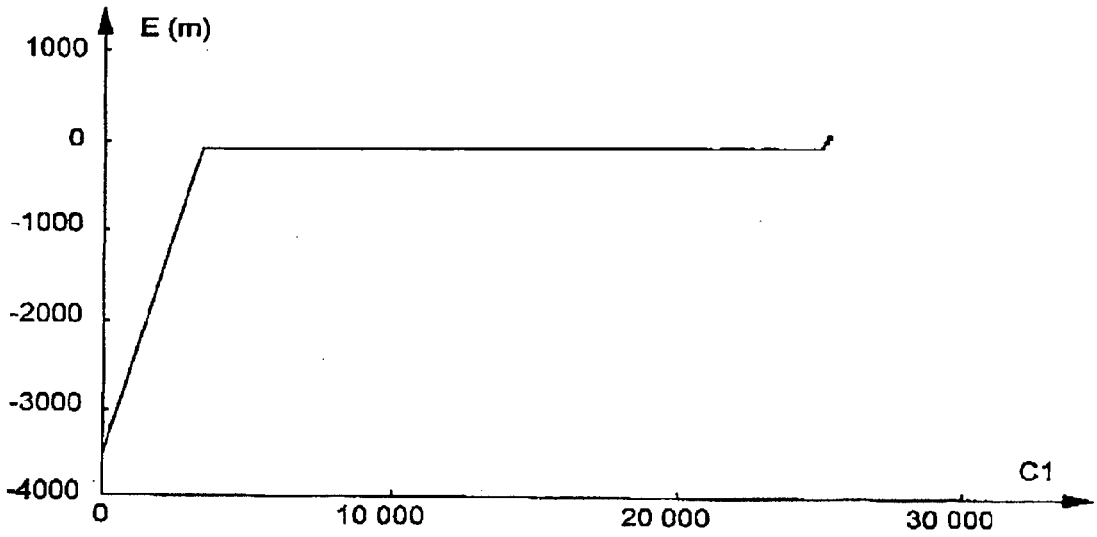
FIG. 6 shows an example of topography of a sea line (variation of elevation E as a function of curvilinear abscissa ca) comprising a riser at its ends.

Three distinct parts can be seen in the topography example of FIG. 6. It starts with a 3-km long riser, followed by a 20-km long sawtoothed horizontal part and ending with a 200-m long riser, also sawtoothed. Its spectrum is the spectrum of FIG. 5. The first triplet, which meets the thresholding criterion, consists of points 4, 5 and 6. The simplification threshold is the point of index 6. A jump greater than 2 in the logarithmic scale separates the horizontal plateaus on either side of points 5 and 6. It is thus possible to check that the points on the left of index 5 have weights that are at least 100 times greater than those on the right of index 6.

Figure 7:
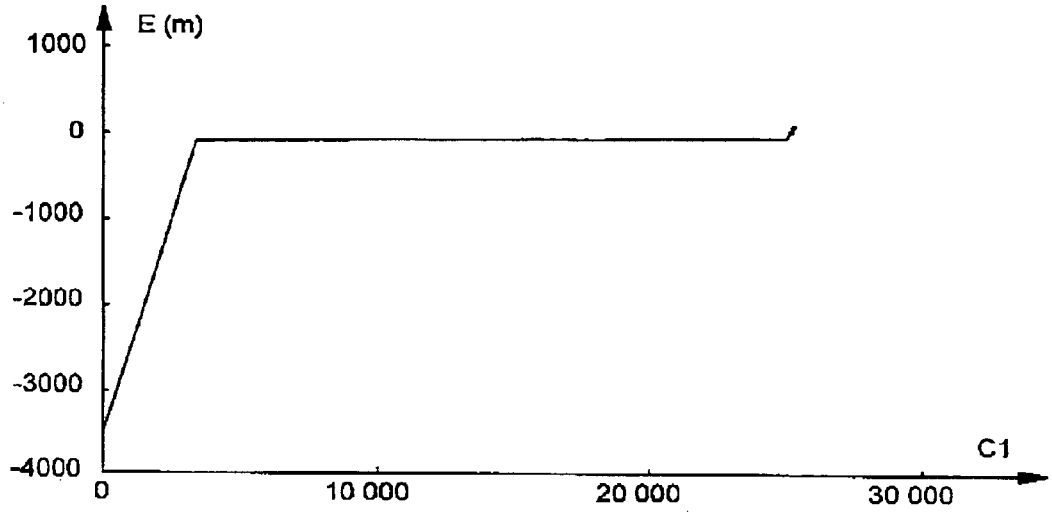
FIG. 7 shows the simplified topography of the same line, obtained by selection of the weights.

In this example, the topography is simplified by keeping only the points of the curvilinear abscissa corresponding to the weights that are greater than or equal to the weight of point 6. The simplified topography of FIG. 7 is obtained. The global shape is kept. All the slight sawtoothed variations on the 20-km long horizontal part have been suppressed. The number of points has changed from 43 initially (FIG. 6) to 6, that is, reduction by a factor of 7. This case is particularly well suited for thresholding since the various orders of magnitude are visible on the initial topography.

The first simplification mode that has been described is easy to implement and based on relatively simple algorithms that can be quickly executed. It is suited to topographies having several orders of magnitude, such as the previous topography that has been considerably simplified because it contained points with weights that were negligible in relation to one another.

Figure 8:
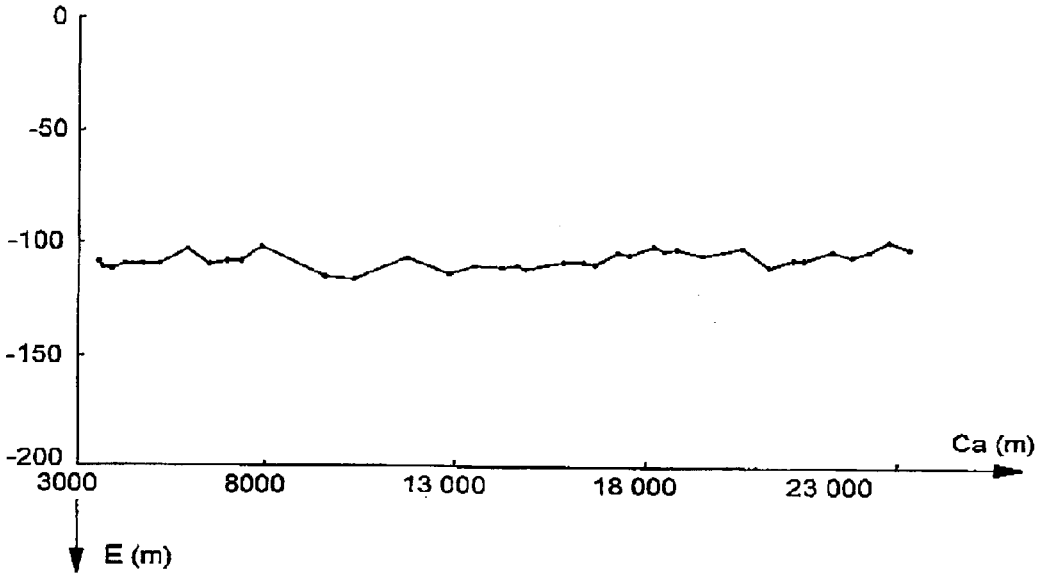
FIG. 8 shows that, without the terminal risers, the general shape of the same line is more difficult to show.

The problem is quite different if only the central part of this topography is taken into account, the terminal risers being removed, because in this case, as can be seen in FIG. 8, the general shape of the pipe is more difficult to show. Simplification of this topography by a line connecting the starting point and the end point is not possible. The spectrum is exactly the same as the spectrum of the initial topography, apart from the fact that it starts at point 6. No threshold is present in this part of the spectrum, the points all have the same order of magnitude. And even if the greatest weight is more than 100 times greater than the smallest, one goes from one to the other continuously.

I-2) Second Simplification Mode

For topographies with points having the same order of magnitude, that cannot be processed with the previous thresholding method, spectral filtering is carried out. The slight pipe profile variations lead to high frequencies in the Fourier spectrum of the function representative of the topography. The topography can be simplified by cutting or by attenuating the highest frequencies of the frequency spectrum thereof.

The topographic function is therefore sampled and its spectrum is determined by means of the FFT (Fast Fourier Transform) method. The sampling interval must be small enough to show all the frequency ranges while avoiding aliasing. The number of sampling points is therefore so selected that the smallest pipe section contains at least two subdivisions to ensure that the Fourier transform will act upon all the parts of the pipe, even the most insignificant ones. Attenuation of the high frequencies must of course be done judiciously and it must be adjusted so that the topographic function obtained remains representative of the initial function.

Figure 9:
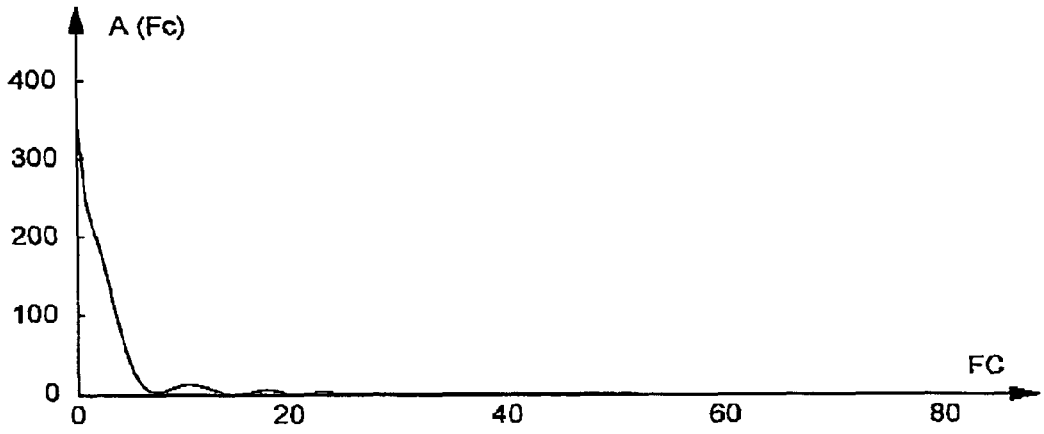
FIG. 9 shows a typical frequency spectrum of a pipe.

The simplest filtering method consists for example in applying a threshold, all the Fourier coefficients (FC) whose amplitude A(FC) is below this threshold being eliminated (coefficients below 40 for instance in the example of FIG. 9). Only the information contained in the frequencies below this threshold is kept. The corresponding simplified topography is reconstructed by inverse transform.

The maximum number of oscillations of the reconstructed signal is thus set by fixing a cutoff frequency. If only the first ten frequencies are kept, the reconstructed function will follow the general shape of the pipe, with a maximum of twenty extrema.

II) Selection of the Cell Sizes on Each Pipe Section

Principle

The gridding principle grids independently the pipe sections between two imposed edges. Since the advantage of a correct gridding is to allow correct observation of the liquid accumulations in the bends, gridding is preferably refined down at the points of the topography where liquid or gas is likely to accumulate. A short cell is therefore preferably placed before and after each bend, larger ones being positioned between the bends. On the other hand, fine gridding of the intermediate parts of the sections between the bends is unnecessary.

The topography of the pipe having been previously simplified (when necessary) and reduced to a certain number of sections, a minimum size and a maximum size are fixed for the cells. The edges of each one (inlet, outlet) are first isolated by small cells, then cell edges are inserted on the central part thereof, which is longer. It is generally not necessary to refine down the grid pattern at the inlet and at the outlet outside the portions at the ends of each section, and edges can therefore be inserted over a large part of the length of each section (⅔ of the length for example) of the maximum size that has been set.

Figure 10:
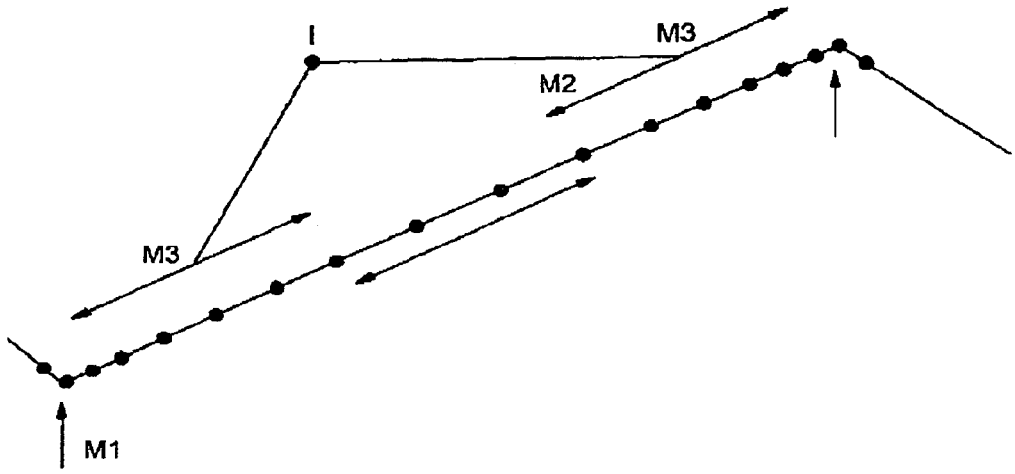
FIG. 10 shows an example of a pipe section with a distribution of cells of various sizes, the smallest ones M1 being positioned at the bends, the largest ones M2 being placed in the central third, the intermediate cells M3 being interposed and resulting from an interpolation I between the others.

The distribution can be so selected that, for example, the size of the cells after that following a bend gradually increases over a third of the length of the section, remains constant over the following third and eventually decreases over the last third before the final short cell as shown in FIG. 10.

Definition of the Minimum and Maximum Cell Lengths

Two cell lengths are defined, a minimum length for isolating the cell edges imposed by small cells, and a maximum length for gridding the middle of the sections contained between two short cells.

All the cells that are inserted after these two stages are deduced from the initial cells by interpolation between a short cell and a long cell. They therefore have intermediate sizes. This property is interesting. It shows that the total number of cells will necessarily range between the number that would have been obtained by homogeneously gridding with the minimum length and the number obtained in the same way but with the maximum length. The total number of cells can thus be controlled from the minimum and maximum sizes.

One of the constraints of automatic gridding lies in the total number of cells. It must generate the shortest possible simulation time, while allowing good display of the physical phenomena. Experience shows, on the one hand, that a discretization of less than 40 cells does not allow good physical description of the problems. On the other hand, grid patterns with more than 150 cells generate simulations which are too long. Default gridding must therefore be flexible enough and comprise 40 to 100 cells.

Such a small number of cells is not always suitable. The ideal number of cells for a precise case depends on several factors taken into account in the numerical pattern. For the same topography for example, a case comprising a large number of section changes requires a finer grid. The method according to the invention allows the user considerable latitude to select the suitable total number of cells.

From this number N, the code calculates the minimum Min and maximum Max lengths as follows:

$$\text{Min} = \frac{L}{N+P}$$

$$\text{Max} = \frac{L}{N-P}$$

Parameter P allows reduction of the difference between the minimum and maximum lengths so as to make the grid progressively homogeneous for the large number of cells.

This parameter is for example defined as follows. For a number of cells selected less than or equal to 60 for example, it is set at 60 for example. It is the default grid. The value of the parameter is 40. The value of the smallest cell will be L/100 and the value of the largest cell, L/20. The total number of cells will range between 20 and 100.

A number of cells greater than or equal to 150 means that the modelling process to be dealt with is certainly more delicate. A homogeneous grid therefore has to be constructed. The minimum and maximum sizes must then be close to one another. The parameter is therefore set at 10. The total number of cells will then range between $$\frac{L}{N+10} \text{ and } \frac{L}{N-10}.$$

Above 150, the desired number of cells is obtained to within 20 cells.

For the grid to become progressively homogeneous between 60 and 150 cells, the parameter is calculated by linear interpolation between the two domains, which is expressed as follows:

P=40 if N<60

$$P = -\frac{1}{3}N + 60 \text{ if } 60 < N < 150$$

P=10 if N>150.

This parameter being determined, it is possible to isolate the edges imposed by short cells and to discretize the middle of the sections by long cells.

It only remains to find a means for gradually going from a short cell to a long cell. The lengths of the three cells are known, and cell edges are to be inserted on the central part. The sizes of the cells thus created must range between the sizes of the extreme cells. Starting from the smallest one, the next cell must always be longer than the previous one, but shorter than the next.

In the general case, there is no pair $(f,n)\in(R,N)$ such that:

the size of a cell is deduced from that of the previous one by multiplying it by a factor f, the sum of the n lengths thus created is equal to (L1+L2), the size of the last cell can be expressed as follows: $f^{n+1}, L_1 f$.

This is also the case for a possible linear interpolation between the two cells. Knowing the three lengths imposes an overabundance of data in relation to the unknowns. It is then impossible to meet all the constraints.

Figure 11:
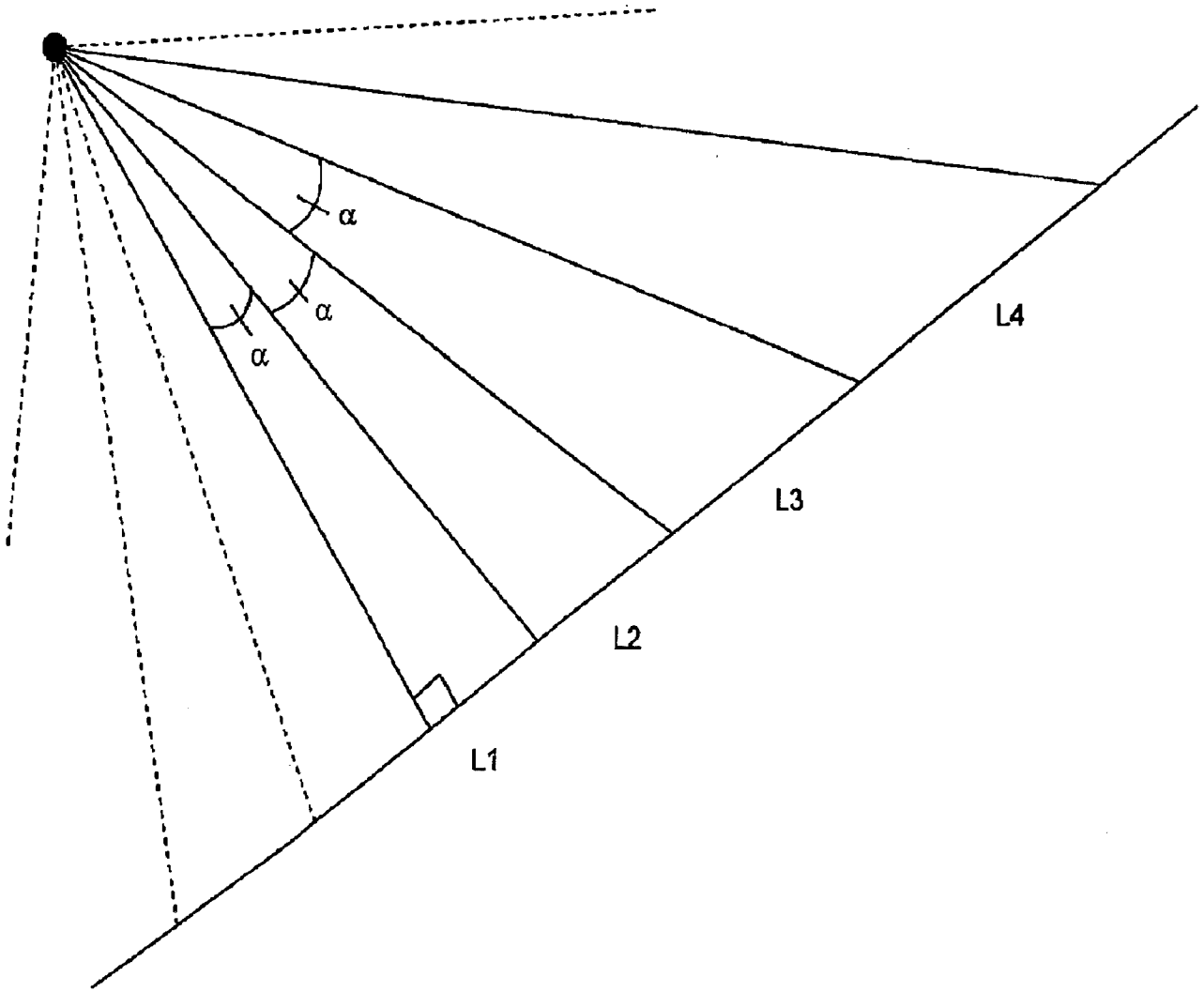
FIG. 11 shows a mode of forming cells of increasing size.

In order to overcome this difficulty, a geometric type method is proposed, using the property according to which segments L1, L2, L3, L4 formed on an axis by the lines of a regular pencil (with a constant angular space $\alpha$ in relation to one another), whose vertex is outside this axis, vary progressively (FIG. 11).

Figure 12:
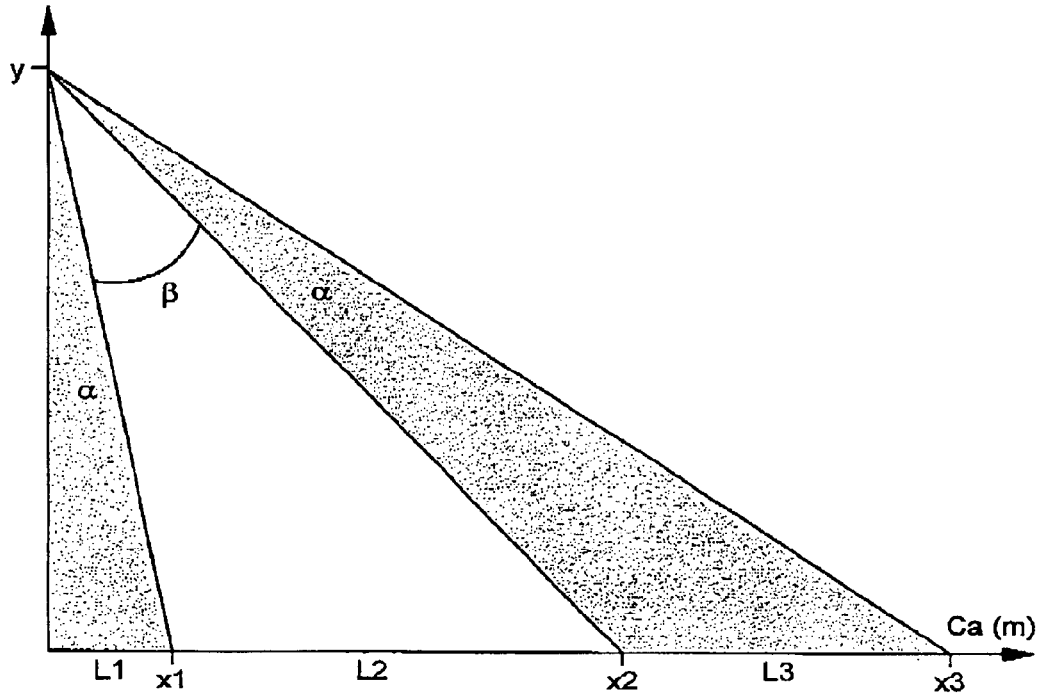
FIG. 12 illustrates the mode of angular division of an intermediate portion on a pipe section.
Figure 13:
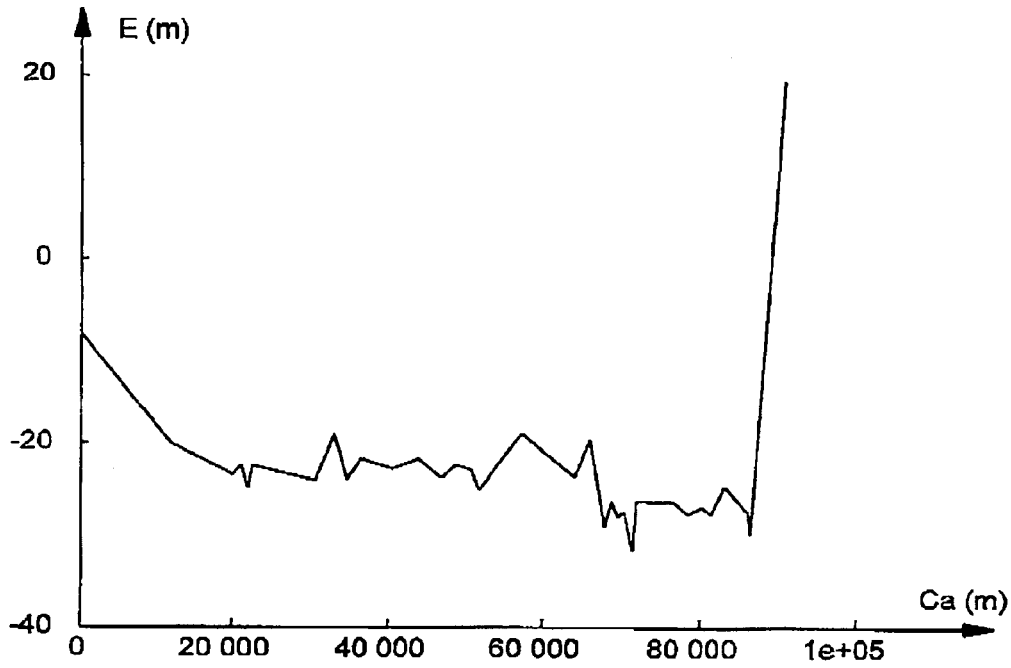
FIG. 13 shows the grid pattern obtained by implementing the method, on a 90-km long subsea line.

A pipe section (FIG. 12) is considered starting with a small cell (0, x1) of length L1 and ended by a cell (x2, x3) of length L3>L1. It can be shown that there is a point on a perpendicular to the pipe section at abscissa 0 such that the cells of lengths L1 and L3 are seen from this point under the same angle $\alpha$. The ordinate y of this vertex is given by the relation:

$$y = \sqrt{\frac{L_1(L_1+L_2)(L_1+L_2+L_3)}{(L_3-L_1)}}$$

wherein L2 is the length of segment (x1, x2).

Angle β then has to be divided into N equal parts, N being equal to the entire division of β by α, i.e.

$$N = E\left(\frac{\beta}{\alpha}\right).$$

Each of the N angles dividing β is always greater than or equal to α.

The principle used for inserting the cell edges is both simple and reliable. It allows, by means of a single parameter, to create either a uniform grid, or a heterogeneous grid fined down at the important points.

What is claimed is:

1. An automatic gridding method of a pipe for modelling fluids carried by the pipe, comprising:

defining a minimum cell size and a maximum cell size for the gridding of the pipe;

subdividing the pipe into sections delimited by bends of the pipe;

positioning a cell of minimum size on either side of each bend;

positioning a cell, whose size is at most equal to the maximum cell size, in a central part of each section and defining two intermediate portions delimited by each cell of the minimum size and the cell whose size is at most equal to the maximum cell size;

gridding the pipe by distributing on the two intermediate portions intermediate cells of increasing or decreasing sizes from the minimum cell size to the size of the cell whose size is at most equal to the maximum cell size; and implementing codes for modeling the fluids carried by the pipe from the gridding of the pipe.

2. A method as claimed in claim 1, wherein sizes of the intermediate cells vary from the minimum size to a size of the cell whose size is at most equal to the maximum cell size.

3. A method as claimed in claim 2, wherein:

the intermediate cells are distributed on the intermediate portions of each section by defining for each intermediate portion lines intersecting at a point of intersection, and forming an angle between the lines, determining for each intermediate portion points of intersection between the portion and the lines; and distributing the intermediate cells according to the points of intersection.

4. A method as claimed in claim 3, comprising:

previously simplifying a topography of the pipe before automatic gridding of the pipe.

5. A gridding method as claimed in claim 4, comprising:

determining a curve representative of the topography of the pipe by representing the pipe as a graph connecting a curvilinear abscissa and a level variation;

simplifying sections of the pipe by assigning to each point of the curve between two successive sections a weight accounting for a length of the sections of the pipe and respective slopes thereof; and selecting among points arranged in an increasing or decreasing order of weight, points whose weight is greatest.

6. A method as claimed in claim 5, comprising:

selecting points of the curve whose weight is greatest by locating in an arrangement of the points a weight discontinuity that is above a fixed threshold.

7. A gridding method as claimed in claim 4, comprising:

determining a curve representative of the topography of the pipe by representing the pipe as a graph connecting a curvilinear abscissa and a level variation of the pipe;

simplifying sections of the pipe by forming a frequency spectrum of the curve representative of the topography of the pipe;

attenuating highest frequencies of the frequency spectrum showing smallest variations of the topography of the pipe; and reconstructing a simplified topography of the pipe corresponding to a rectified frequency spectrum.

8. A method as claimed in claim 7, comprising:

sampling the curve representative of the topography of the pipe with a sampling interval selected so that a smallest pipe section contains at least two sampling intervals;

determining the frequency spectrum of the sampled curve;

correcting the frequency spectrum by low-pass filtering using a cutoff frequency selected according to a maximum number of cells used for subdividing the pipe; and determining the topography of the pipe corresponding to the rectified frequency spectrum.

9. A method as claimed in claim 2, comprising:

determining a position of the point of intersection for each intermediate portion by defining an axis passing through a bend of each intermediate portion and a perpendicular to each intermediate portion; and determining a position of the point of intersection on the axis at a distance from a bend which is a function of the minimum cell size, a size of the cell whose size is at most equal to the maximum cell size and of a distance between the cell of minimum cell size and the cell whose size is at most equal to the maximum cell size.

10. A method as claimed in claim 9, comprising:

previously simplifying a topography of the pipe before automatic gridding of the pipe.

11. A gridding method as claimed in claim 10, comprising:

determining a curve representative of the topography of the pipe by representing the pipe as a graph connecting a curvilinear abscissa and a level variation;

simplifying sections of the pipe by assigning to each point of the curve between two successive sections a weight accounting for a length of the sections of the pipe and respective slopes thereof; and selecting among points arranged in an increasing or decreasing order of weight, points whose weight is greatest.

12. A method as claimed in claim 11, comprising:

selecting points of the curve whose weight is greatest by locating in an arrangement of the points a weight discontinuity that is above a fixed threshold.

13. A gridding method as claimed in claim 10, comprising:

determining a curve representative of the topography of the pipe by representing the pipe as a graph connecting a curvilinear abscissa and a level variation of the pipe;

simplifying sections of the pipe by forming a frequency spectrum of the curve representative of the topography of the pipe;

attenuating highest frequencies of the frequency spectrum showing smallest variations of the topography of the pipe; and reconstructing a simplified topography of the pipe corresponding to a rectified frequency spectrum.

14. A method as claimed in claim 13, comprising:

sampling the curve representative of the topography of the pipe with a sampling interval selected so that a smallest pipe section contains at least two sampling intervals;

determining the frequency spectrum of the sampled curve;

correcting the frequency spectrum by low-pass filtering using a cutoff frequency selected according to a maximum number of cells used for subdividing the pipe; and determining the topography of the pipe corresponding to the rectified frequency spectrum.

15. A method as claimed in claim 2, comprising:

previously simplifying a topography of the pipe before automatic gridding of the pipe.

16. A gridding method as claimed in claim 15, comprising:

determining a curve representative of the topography of the pipe by representing the pipe as a graph connecting a curvilinear abscissa and a level variation;

simplifying sections of the pipe by assigning to each point of the curve between two successive sections a weight accounting for a length of the sections of the pipe end respective slopes thereof; and selecting among points arranged in an increasing or decreasing order of weight, points whose weight is greatest.

17. A method as claimed in claim 16, comprising:

selecting points of the curve whose weight is greatest by locating in an arrangement of the points a weight discontinuity that is above a fixed threshold.

18. A gridding method as claimed in claim 15, comprising:

determining a curve representative of the topography of the pipe by representing the pipe as a graph connecting a curvilinear abscissa and a level variation of the pipe;

simplifying sections of the pipe by forming a frequency spectrum of the curve representative of the topography of the pipe;

attenuating highest frequencies of the frequency spectrum showing smallest variations of the topography of the pipe; and reconstructing a simplified topography of the pipe corresponding to a rectified frequency spectrum.

19. A method as claimed in claim 18, comprising:

sampling the curve representative of the topography of the pipe with a sampling interval selected so that a smallest pipe section contains at least two sampling intervals;

determining the frequency spectrum of the sampled curve;

correcting the frequency spectrum by low-pass filtering using a cutoff frequency selected according to a maximum number of cells used for subdividing the pipe; and determining the topography of the pipe corresponding to the rectified frequency spectrum.

20. A method as claimed in claim 1, wherein:

the intermediate cells are distributed on the intermediate portions of each section by defining for each intermediate portion lines intersecting at a point of intersection, and forming an angle between the lines, determining for each intermediate portion points of intersection between the portion and the lines; and distributing the intermediate cells according to the points of intersection.

21. A method as claimed in claim 20, comprising:

previously simplifying a topography of the pipe before automatic gridding of the pipe.

22. A gridding method as claimed in claim 21, comprising:

determining a curve representative of the topography of the pipe by representing the pipe as a graph connecting a curvilinear abscissa and a level variation;

simplifying sections of the pipe by assigning to each point of the curve between two successive sections a weight accounting for a length of the sections of the pipe and respective slopes thereof; and selecting among points arranged in an increasing or decreasing order of weight, points whose weight is greatest.

23. A method as claimed in claim 22, comprising:

selecting points of the curve whose weight is greatest by locating in an arrangement of the points a weight discontinuity that is above a fixed threshold.

24. A gridding method as claimed in claim 21, comprising:

determining a curve representative of the topography of the pipe by representing the pipe as a graph connecting a curvilinear abscissa and a level variation of the pipe;

simplifying sections of the pipe by forming a frequency spectrum of the curve representative of the topography of the pipe;

attenuating highest frequencies of the frequency spectrum showing smallest variations of the topography of the pipe; and reconstructing a simplified topography of the pipe corresponding to a rectified frequency spectrum.

25. A method as claimed in claim 24, comprising:

sampling the curve representative of the topography of the pipe with a sampling interval selected so that a smallest pipe section contains at least two sampling intervals;

determining the frequency spectrum of the sampled curve;

correcting the frequency spectrum by low-pass filtering using a cutoff frequency selected according to a maximum number of cells used for subdividing the pipe; and determining the topography of the pipe corresponding to the rectified frequency spectrum.

26. A method as claimed in claim 1, comprising:

previously simplifying a topography of the pipe before automatic gridding of the pipe.

27. A method as claimed in claim 26, comprising:

determining a curve representative of the topography of the pipe by representing the pipe as a graph connecting a curvilinear abscissa and a level variation;

simplifying sections of the pipe by assigning to each point of the curve between two successive sections a weight accounting for a length of the sections of the pipe and respective slopes thereof; and selecting among points arranged in an increasing or decreasing order of weight, points whose weight is greatest.

28. A method as claimed in claim 27, comprising:

selecting points of the curve whose weight is greatest by locating in an arrangement of the points a weight discontinuity that is above a fixed threshold.

29. A method as claimed in claim 26, comprising:

determining a curve representative of the topography of the pipe by representing the pipe as a graph connecting a curvilinear abscissa and a level variation of the pipe;

simplifying sections of the pipe by forming a frequency spectrum of the curve representative of the topography of the pipe;

attenuating highest frequencies of the frequency spectrum showing smallest variations of the topography of the pipe; and reconstructing a simplified topography of the pipe corresponding to a rectified frequency spectrum.

30. A method as claimed in claim 29, comprising:

sampling the curve representative of the topography of the pipe with a sampling interval selected so that a smallest pipe section contains at least two sampling intervals;

determining the frequency spectrum of the sampled curve;

correcting the frequency spectrum by low-pass filtering using a cutoff frequency selected according to a maximum number of cells used for subdividing the pipe; and determining the topography of the pipe corresponding to the rectified frequency spectrum.

* * * * *